US007673457B2

(12) United States Patent
Bessagnet et al.

(10) Patent No.: US 7,673,457 B2
(45) **Date of Patent: *Mar. 9, 2010**

(54) TURBINE ENGINE COMBUSTION CHAMBER WITH TANGENTIAL SLOTS

(75) Inventors: Florian Andre Francois Bessagnet, Antony (FR); Mario Cesar De Sousa, Cesson (FR)

(73) Assignee: SNECMA, Paris (FR)

( * ) Notice: Subject to any disclaimer, the term of this patent is extended or adjusted under 35 U.S.C. 154(b) by 475 days.

This patent is subject to a terminal disclaimer.

(21) Appl. No.: 11/670,510

(22) Filed: Feb. 2, 2007

(65) Prior Publication Data

US 2008/0010997 A1 Jan. 17, 2008

(30) Foreign Application Priority Data

Feb. 8, 2006 (FR) ..... 06 50447

(51) Int. Cl.
*F02C 1/00* (2006.01)
*F02G 3/00* (2006.01)

(52) U.S. Cl. ..... 60/752; 60/804; 60/798

(58) Field of Classification Search ..... 60/752–760, 60/796, 798, 800, 804
See application file for complete search history.

(56) References Cited

U.S. PATENT DOCUMENTS 3,854,285 A * 12/1974 Stenger et al. ..... 60/756
4,433,214 A * 2/1984 Jasinski ..... 381/398
5,181,377 A * 1/1993 Napoli et al. ..... 60/796
5,285,635 A * 2/1994 Savelli et al. ..... 60/804
5,331,815 A * 7/1994 Reinhold et al. ..... 60/748
5,524,430 A * 6/1996 Mazeaud et al. ..... 60/798
6,148,600 A * 11/2000 Farmer et al. ..... 60/772
6,397,603 B1 * 6/2002 Edmondson et al. ..... 60/753
6,449,952 B1 * 9/2002 Emilianowicz et al. ..... 60/772
6,655,146 B2 * 12/2003 Kutter et al. ..... 60/752
6,655,149 B2 * 12/2003 Farmer et al. ..... 60/754
6,672,067 B2 * 1/2004 Farmer et al. ..... 60/752
6,779,268 B1 8/2004 Farmer
6,895,761 B2 * 5/2005 Mitchell et al. ..... 60/796
6,904,757 B2 * 6/2005 Mitchell et al. ..... 60/800
7,017,350 B2 * 3/2006 De Sousa et al. ..... 60/796

(Continued)

FOREIGN PATENT DOCUMENTS

DE 42 23 733 A1 1/1994

(Continued)

OTHER PUBLICATIONS

U.S. Appl. No. 11/670,571, filed Feb. 2, 2007, Bessagnet, et al.

*Primary Examiner*—William H Rodriguez
(74) *Attorney, Agent, or Firm*—Oblon, Spivak, McClelland, Maier & Neustadt, L.L.P.

(57) ABSTRACT

A turbine engine annular combustion chamber, including longitudinal walls connected by a transverse chamber bottom and a single-piece cowling, the chamber bottom and the cowling each including an inner flange and an outer flange each with a plurality of holes made in it for the passage of fixing systems for fixing the cowling on the chamber bottom. Each fixing system has associated with it at least one tangential slot formed on the corresponding flange of the chamber bottom and/or on the corresponding flange of the cowling, each slot being formed in the immediate vicinity of the corresponding fixing system.

12 Claims, 3 Drawing Sheets

U.S. PATENT DOCUMENTS

| | | | | |
|---|---|---|---|---|
| 7,062,920 | B2 * | 6/2006 | McMasters et al. | 60/800 |
| 7,093,441 | B2 * | 8/2006 | Burd et al. | 60/752 |
| 7,121,095 | B2 * | 10/2006 | McMasters et al. | 60/746 |
| 7,222,488 | B2 * | 5/2007 | Farmer et al. | 60/747 |
| 2008/0110174 | A1 * | 5/2008 | Brown et al. | 60/752 |

FOREIGN PATENT DOCUMENTS

| | | | |
|---|---|---|---|
| EP | 0 924 458 | A1 | 6/1999 |
| EP | 1 479 975 | A1 | 11/2004 |
| GB | 648493 | | 1/1951 |
| WO | WO 96/18850 | | 6/1996 |

* cited by examiner

TURBINE ENGINE COMBUSTION CHAMBER WITH TANGENTIAL SLOTS

BACKGROUND OF THE INVENTION

The present invention relates to the general field of annular combustion chambers for turbine engines equipped with a single-piece protective cowling for the fuel injection systems A turbine engine annular combustion chamber is generally made up of two longitudinal walls generated by revolution (an outer wall and an inner wall) which are connected upstream by a transverse wall forming the chamber bottom.

The present invention relates more particularly to combustion chambers that also comprise a single-piece cowling mounted upstream of the chamber bottom. The cowling is used in particular to protect the fuel injection systems which are mounted on the chamber bottom.

Assembling these different elements of the combustion chamber is carried out by means of bolt connections mounted at the inner and outer walls. More precisely, the chamber bottom and the cowling each comprise an inner flange and an outer flange on which respectively the inner wall and the outer wall of the combustion chamber are fixed by bolt connections, these longitudinal walls being inserted between the cowling and the chamber bottom. Thus, the same bolt connection passes through all the following: one of the longitudinal walls, the chamber bottom and the cowling of the combustion chamber.

In practice, this type of combustion chamber architecture poses many problems. In particular, the different elements of the combustion chamber have large manufacturing tolerances, which leads to stacking up of the tolerances resulting in poor closing up between these elements when the combustion chamber is being assembled, which creates a loss as regards the clamping transiting between the flanges. This is because the part of the clamping which is used for deforming the chamber is subtracted from the force of reactions between its components. When this reaction force decreases, the force necessary for making the parts slide among one another is therefore less. An additional clamping torque is therefore necessary for taking up the play due to the manufacturing tolerances of the components and thus keeping the correct clamping force for passage of the sliding forces transiting in the connection. Therefore, during operation, the vibrations caused by the combustion of gases inside the combustion chamber often lead to the formation of cracks in the region of the bolt connections on the cowling and/or the chamber bottom. Such cracks are particularly prejudicial to the service life of the combustion chamber

OBJECT AND SUMMARY OF THE INVENTION

The principal object of the present invention is therefore to overcome such drawbacks by proposing an annular combustion chamber architecture that is easy to assemble and has sufficient flexibility to avoid the formation of cracks whilst retaining a necessary clamping effectiveness.

To that end, a turbine engine annular combustion chamber is provided, comprising longitudinal walls connected by a transverse chamber bottom and a single-piece cowling, the chamber bottom and the cowling each comprising an inner flange and an outer flange each with a plurality of holes made in it for the passage of fixing systems for fixing the cowling on the chamber bottom, characterised in that each fixing system has associated with it at least one tangential slot formed on the corresponding flange of the chamber bottom and/or on the corresponding flange of the cowling, each slot being formed in the immediate vicinity of the corresponding fixing system.

The presence of at least one tangential slot in the region of each fixing system makes it possible, on the one hand, to increase the closing-up flexibility between the three main components of the combustion chamber thus providing better clamping between these components, and, on the other hand, to reduce the mechanical stresses in the region of the fixing systems. Therefore, the total clamping torque will be reduced in order to approach that necessary solely for passage of the forces in service. The assembly of the combustion chamber is thereby facilitated and its service life increased.

Another object of the invention is a turbine engine comprising an annular combustion chamber as defined previously.

BRIEF DESCRIPTION OF THE DRAWINGS

Other features and advantages of the present invention will emerge from the description given below, with reference to the appended drawings which illustrate an embodiment thereof lacking any limiting nature. In the figures.

DETAILED DESCRIPTION OF ONE EMBODIMENT

Figure 1:
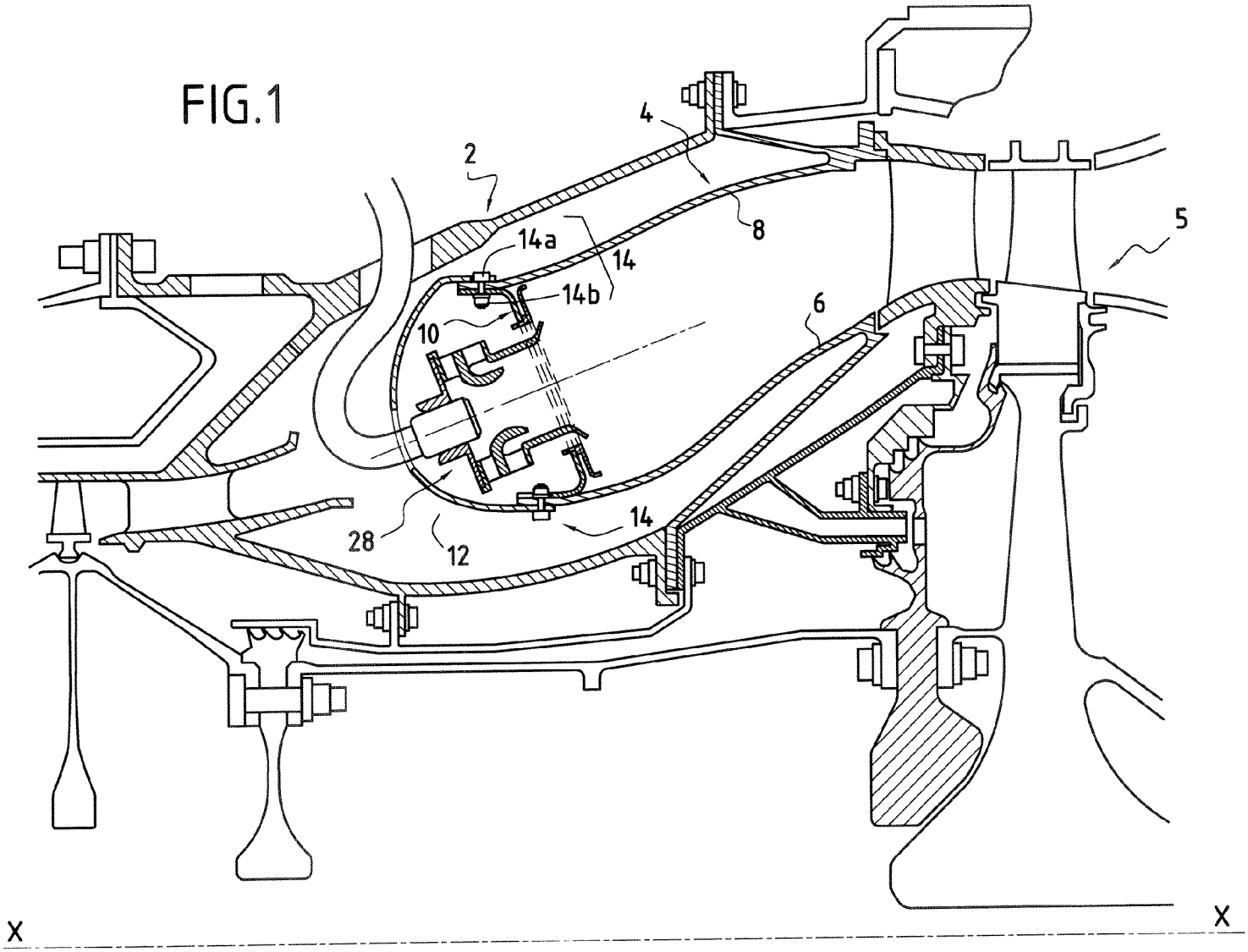
FIG. 1 is a view in longitudinal section of a turbine engine combustion chamber according to the invention.
Figure 2:
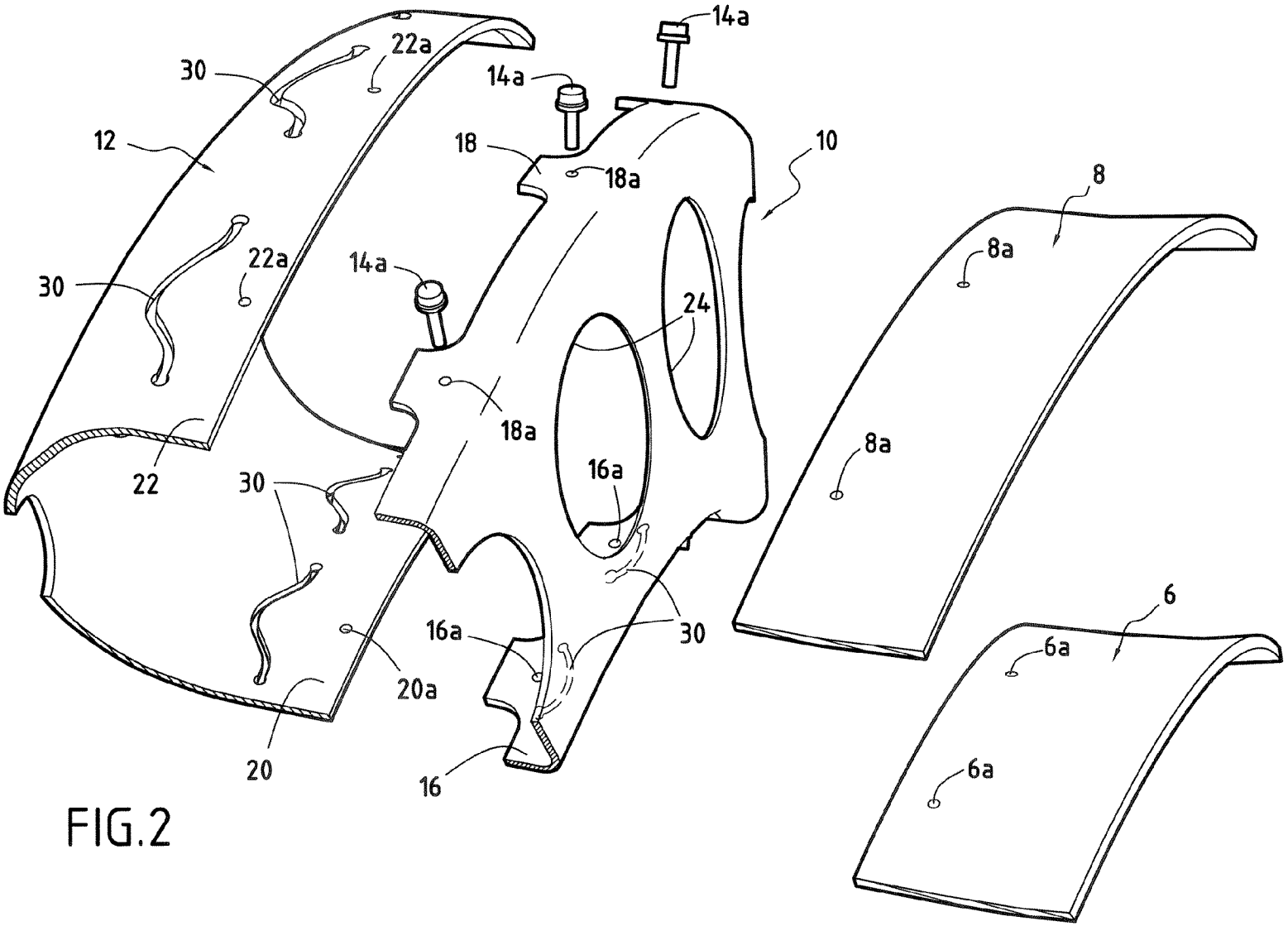
FIG. 2 is a partial view in perspective of the combustion chamber of FIG. 1 before its assembly.
Figure 3:
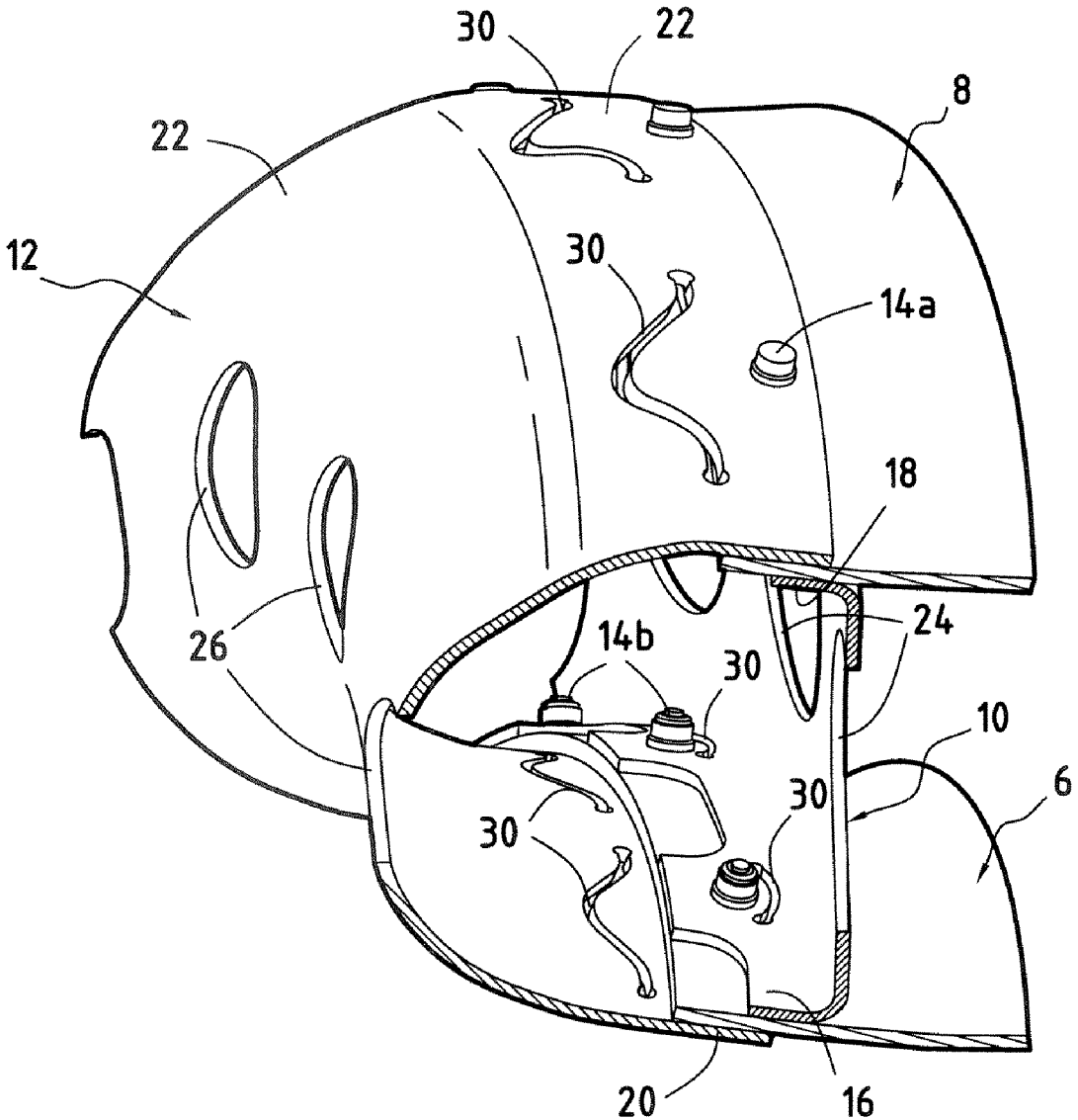
FIG. 3 is a partial view in perspective of the combustion chamber of FIG. 2 after its assembly.

FIGS. 1 to 3 illustrate a combustion chamber for a turbine engine according to the invention.

A turbine engine of this kind, for example an aeronautical one, comprises in particular a compression section (not shown) wherein air is compressed before being injected into a chamber housing 2, and then into a combustion chamber 4 mounted inside the latter.

The compressed air is introduced into the combustion chamber and mixed with fuel before being burned therein. The gases resulting from this combustion are then directed to a high-pressure turbine 5 arranged at the output of the combustion chamber.

The combustion chamber 4 is of annular type. It is made up of an inner annular wall 6 and an outer annular wall 8 which extend in a substantially longitudinal direction with respect to the longitudinal axis X-X of the turbine engine.

These longitudinal walls 6, 8 are joined upstream (with respect to the direction of flow of the combustion gases in the combustion chamber) by a transverse wall 10 forming the chamber bottom. The combustion chamber also comprises a single-piece cowling 12 (that is to say a cowling made in one and the same piece) covering the chamber bottom 10.

The main components of the combustion chamber (namely the longitudinal walls 6, 8, the chamber bottom 10 and the cowling 12) are assembled together by means of a plurality of fixing systems 14 distributed in a regular manner over the entire circumference of the combustion chamber and each made up of a bolt 14*a* and a clamping nut 14*b*.

More precisely, as illustrated in FIGS. 2 and 3, the chamber bottom 10 comprises an inner flange 16 and an outer flange 18 extending longitudinally in the upstream direction and each provided with holes, respectively 16*a* and 18*a*, for the passage of fixing bolts 14*a*.

Similarly, the single-piece cowling 12 comprises an inner flange 20 and an outer flange 22 which extend longitudinally in the downstream direction and which are each provided with holes, respectively 20*a* and 22*a*, for passage of the fixing bolts 14*a*.

As regards the longitudinal walls 6, 8 of the combustion chamber, these also have a plurality of holes, respectively 6*a* and 8*a*, made in them at their upstream end for passage of the fixing bolts 14*a*.

Assembling of these components of the combustion chamber is carried out by inserting the longitudinal walls 6, 8 between the respective flanges of the chamber bottom 10 and of the cowling 12 as depicted in FIGS. 1 and 3. The assembly is then held by the fixing bolts 14*a* on which the nuts 14*b* are tightened, it being possible for the latter to be welded on the chamber bottom 10 if necessary.

Furthermore, the chamber bottom 10 and the cowling 12 of the combustion chamber are each provided with a plurality of openings, respectively 24 and 26, for the passage of fuel injection systems 28.

According to the invention, each fixing system 14 has associated with it at least one tangential slot 30 formed on the corresponding flange 16, 18 of the chamber bottom 10 and/or on the corresponding flange 20, 22 of the cowling 12, each tangential slot being formed in the immediate vicinity of the corresponding fixing system.

Tangential slot must be understood to mean a slot that extends in a substantially tangential (or circumferential) direction with respect to the general annular geometry of the combustion chamber. A tangential slot in fact makes it possible to reduce the tangential stresses in the region of each fixing system and thus reduce the risks of formation of cracks.

In the embodiment illustrated by FIGS. 1 to 3, if one of the fixing systems 14 intended for assembling the inner longitudinal wall 6 on the chamber bottom 10 is considered, both the inner flange 16 of the chamber bottom and the inner flange 20 of the cowling 12 are provided with a tangential slot 30 formed in the immediate vicinity of the fixing system.

In the same way, considering one of the fixing systems 14 intended for assembling the outer longitudinal wall 8 on the chamber bottom 10, the outer flange 18 of the chamber bottom and the outer flange 22 of the cowling 12 are each provided with a tangential slot 30 made in the immediate vicinity of the fixing system.

Alternatively, for each fixing system, only one of the corresponding flanges of the chamber bottom and the cowling could be provided with such a tangential slot.

The tangential slots are formed in the immediate vicinity of the fixing systems 14, that is to say they are not intended to be arranged between two adjacent fixing systems for example. This is because the presence of these slots makes it possible to provide flexibility in the region of the fixing systems which are the source of too great a rigidity in the assembling of the combustion chamber components. It should also be noted that the longitudinal walls 6, 8 of the combustion chamber are devoid of such tangential slots which eliminates all risks of a sealing fault and lack of rigidity of these walls.

In the embodiment of FIGS. 1 to 3, the slots 30 extend tangentially over a distance which is substantially the same either side of the fixing systems 14. For the purposes of information, they can have a length (measured tangentially) of approximately Π (3.14) times the assembly diameter divided by twice the number of slots (the grooved length is equal to the non-grooved length).

The geometrical parameters of each slot (dimensions and shape) are defined according to the degree of flexibility it is wished to introduce during assembly of the combustion chamber. The slots are for example obtained by drilling with a water jet or by wire cutting, these operations being controlled by numerical control.

The invention claimed is:

1. A turbine engine annular combustion chamber having a longitudinal axis, said annular combustion chamber comprising longitudinal walls connected by a transverse chamber bottom and a single-piece cowling, the chamber bottom and the cowling each comprising an inner flange and an outer flange, each of said inner and outer flanges extending in a circumferential direction around said longitudinal axis of said annular combustion chamber, and each of said inner and outer flanges including a plurality of holes for the passage of fixing systems for fixing the cowling on the chamber bottom, wherein each fixing system is associated with at least one tangential slot formed on the corresponding flange of the chamber bottom and/or on the corresponding flange of the cowling, each slot being formed in the immediate vicinity of the corresponding fixing system, wherein each slot substantially extends in said circumferential direction.

2. A turbine engine comprising an annular combustion chamber according to claim 1 and a turbine downstream of said annular combustion chamber.

3. A turbine engine annular combustion chamber as in claim 1, wherein each fixing system is associated with at least one tangential slot formed on the corresponding flange of the chamber bottom.

4. A turbine engine annular combustion chamber as in claim 1, wherein each fixing system is associated with at least one tangential slot formed on the corresponding flange of the cowling.

5. A turbine engine annular combustion chamber as in claim 4, wherein each fixing system is associated with at least one tangential slot formed on the corresponding flange of the cowling.

6. A turbine engine annular combustion chamber as in claim 1, wherein the inner and outer flanges are free of any slots between two adjacent tangential slots.

7. A turbine engine annular combustion chamber as in claim 1, wherein each slot is located entirely upstream of an associated fixing system.

8. A turbine engine annular combustion chamber as in claim 1, wherein the longitudinal walls are devoid of any tangential slots.

9. A turbine engine annular combustion chamber as in claim 1, wherein each slot extends over a same distance on either side of the associated fixing system.

10. A turbine engine annular combustion chamber as in claim 1, wherein each slot has two ends, each end on each side of the associated fixing system.

11. A turbine engine annular combustion chamber as in claim 10, wherein each slot has a portion between said two ends, said portion being located upstream relative to said two ends.

12. A turbine engine annular combustion chamber as in claim 1, wherein each slot has two ends, each end being located upstream of the associated fixing system.

* * * * *